United States Patent [19]

Burtin

[11] Patent Number: 4,642,276

[45] Date of Patent: Feb. 10, 1987

[54] METHOD OF ASSESSING THE ACTIVITY OF A PHOTOGRAPHIC DEVELOPER

[75] Inventor: Jean Burtin, Mol, Belgium

[73] Assignee: Agfa-Gevaert, N.V., Mortsel, Belgium

[21] Appl. No.: 780,586

[22] Filed: Sep. 26, 1985

[30] Foreign Application Priority Data

Oct. 4, 1984 [EP] European Pat. Off. ..... 84201412.8

[51] Int. Cl.[4] ..... G03C 5/02; G03C 5/26

[52] U.S. Cl. ..... 430/30; 354/20; 354/297; 430/399

[58] Field of Search ..... 430/30, 399; 354/20, 354/297

[56] References Cited

U.S. PATENT DOCUMENTS

| | | | |
|---|---|---|---|
| 3,623,418 | 11/1971 | Ost | 354/20 |
| 4,081,280 | 3/1978 | Corluy et al. | 430/399 |
| 4,464,036 | 8/1984 | Taniguchi et al. | 430/30 |

OTHER PUBLICATIONS

Carleer et al., "Replenishing system", *Research Disclosure* No. 19620, 8/1980, pp. 331–332.

*Primary Examiner*—Richard L. Schilling

*Attorney, Agent, or Firm*—A. W. Breiner

[57] ABSTRACT

A method and an apparatus wherein wedge print density value comparisons made with the aid of a photoelectric densitometer give indications of the developing activity of a photographic developer which are independent of the temperature of the photodetector.

9 Claims, 1 Drawing Figure

METHOD OF ASSESSING THE ACTIVITY OF A PHOTOGRAPHIC DEVELOPER

This invention relates to the assessment of the developing activity of a photographic developer by a method which comprises the steps of using the developer to develop a latent photographic image of a sensitometric wedge, determining density curve data pertaining to the resulting wedge print (hereafter and in subsequent claims called "color print") by means of a photoelectric transmission densitometer, and comparing such data with analogous data pertaining to at least one reference wedge print resulting from the development of an identical latent sensitometric wedge image in a developer of given activity taken as norm.

During use of a developer solution for developing latent images in a succession of silver halide photographic elements the composition of the solution undergoes change in consequence of the consumption of developing agents and oxidation-inhibiting compounds, the entry of silver halide ions into the solution, and reaction of the solution with oxygen in the atmosphere. The amount of developing agents in the solution becomes reduced both by chemical reactions with exposed silver halide and by inevitable removal of developer liquid together with the photographic elements as they leave the solution.

The rate at which the developer solution becomes exhausted in the absence of replenishment, depends on various factors including temperature, the extent of agitation of the solution, the amount of developed (exposed or fogged) silver halide in the individual photographic elements, and of course the number and the type (positive or negative) of the processed photographic elements.

In the machine processing of silver halide materials e.g. graphic arts materials automatic replenishment systems are used for effecting automatic controlled addition of one or more replenisher solutions to the developer solutions at appropriate times in order to keep the development conditions as constant as possible.

The activity of a developer solution can be periodically assessed by using the solution to develop latent images of sensitometric wedges and comparing density characteristics of the resulting prints with density characteristics of a so-called reference print produced from an identical latent wedge image by means of a developer solution of a predetermined composition taken as norm (see e.g. U.S. Pat. No. 4,081,280).

Change in the developer solution caused by aerial oxidation can be assessed by comparing the distance (hereafter referred to as the density range) separating positions on a control print at which the image densities correspond with two substantially different predetermined values, with the distance separating the same image density values on a reference print. Such predetermined density values may for example be those corresponding with 90% and 5% incident light transmission. In the case of a half-tone wedge print, those are the positions of the so-called 10% and 95% dot values corresponding with 0.04 and 1.30 integrated densities. A density range of a said half-tone print can alternatively be referred to as a screen range.

On the other hand the extent of exhaustion of a developer solution consequent upon its use in developing silver halide material can be assessed by comparing the distances along the control and reference wedge prints at which a point of predetermined image density (a so-called sensitivity point) occurs. The point at which the image density corresponds with 90% incident light transmission (10% dot value on a half-tone wedge print) can for example be taken as the sensitivity point.

The above mentioned kinds of change in the developer solution can be compensated for by addition of replenisher material of appropriate composition. For example, both kinds of change can be compensated for by the addition of two replenisher solutions, one of which compensates for aerial oxidation effects and the other of which compensates for developer exhaustion.

Visual comparison of image densities is not sufficiently reliable for accurate development control purposes and therefore computer-assisted replenisher systems have been developed in which density measurements and comparisons are made automatically using photodetectors. Such a system is described in Research Disclosure RD. 19620, published August 1980, and is commercially available as Agfa-Gevaert's R.E.S.O.X. (Trade Mark) system. In that system, pre-exposed control wedge prints are developed at intervals of time in the developer in use in the processing machine and the locations of predetermined density zones along those prints are compared by a microprocessor with reference values derived from a reference wedge print or from a series of such prints which has or have been processed under controlled conditions. To facilitate automatic recording of the locations of predetermined density zones along the control wedge prints, these include a millimeter scale running parallel with and alongside the wedge image. Depending on the results of the comparison of the predetermined density locations on the control and reference wedge prints, the microprocessor automaticaly calculates the amounts of replenisher solutions required in order to maintain a substantially constant activity of the developer and also of the fixer. The actual formulation and dosage of the replenisher solutions can also be performed automatically, e.g. by using the computer-assisted replenishing unit commercially available under Agfa-Gevaert's Trade Mark GEVA-MIX-AUTO.

Despite the automation of wedge-reading, experience has shown that the density measurements are not entirely reliable. Measurement errors become evident from variations in the activity of the developer indicating incorrect replenishment.

It has become apparent that the faults are attributable to variation in the behavior of the photodetectors with variations in the ambient temperature. The ambient temperature of a photoelectric densitometer is liable to change in course of time with the result that the output current from the photodetector when irradiated by light through a wedge print zone of given density is not independent of the time at which the wedge print is read. An increase in ambient temprature results in an increase in the dark-current and in the incident light-responsive output current values.

Because it is obviously impractical to require the photoelectric measuring device to be used in a room kept at a controlled constant temperature, and self-heating of the measuring device itself may occur, temperature control of the measuring device is not an acceptable solution to the problem referred to.

It is an object of the present invention to provide a method and an apparatus wherein wedge print density value comparisons made with the aid of a photoelectric densitometer give indications of the developing activity of a photographic developer which are independent of the temperature of the photodetector.

The invention provides a method as defined in claim 1 hereof. This method is characterised in that the densitometer is used to determine in respect of the control print: (i) a notional density range in terms of the difference between the dark current of the photodetector of the densitometer and the output current of such detector when it is irradiated by light through the transparent support of such control print at an area of zero image density, and (ii) to determine at least one position along the control print where its image density, as measured in terms of the output current of said detector, is in a predetermined ratio to said notional density range; the data thus established pertaining to the control print is compared with analogous data pertaining to the reference print, established by means of the same densitometer [but not necessarily while the environmental temperature to which it is exposed is the same as that prevailing during the determination of said control print data (i) and (ii)], in order to determine the relationship between the positions along the control and reference prints at which their notional densities are in the same ratio to their respective notional density ranges, and the said relationship is used as a measure of the developing activity of the developer being assessed.

By such a method, because the compared notional density locations (i.e. the locations detected by the photoelectric densitometer) are locations where the notional densities are corresponding proportions of the notional density ranges determined for the density measurements on their respective prints by the same densitometer, ambient temperature change during the time interval between the making of the density measurements on the different prints have no influence on the readings which are used as a measure of the developer activity. It is of course necessary for the temperature of the photodetector of the densitometer at the time such photodetector is used to locate a particular zone within the length of a given wedge print to be the same as the temperature of such photodetector when used to determine the notional density range of that same print. There is of course no problem in complying with this condition because the two kinds of measurement can conveniently be made in immediate succession.

The reference data pertaining to a reference wedge print may be data pertaining to a single actual print or it may be data derived by averaging data derived from a series of wedge prints. Having initially established reference data by measurements performed on a reference wedge print or a said series of reference wedge prints, no further reference wedge prints need be produced or measured. The data pertaining to control wedge prints produced by developing pre-formed latent wedge images by means of the developer at intervals of time have simply to be compared with such initially compiled reference data. That reference data can be stored in coded form in a data processing apparatus for automatically making the required data comparisons and yielding signals indicative of the developing activity of the developer and therefore of the replenishing requirements.

The method has been devised more particularly for use in the processing of graphic arts materials using screen (half-tone) densitometric wedge prints for the assessment purposes.

The notional density range determined for the reading of a given sensitometric wedge print can be taken as the range represented by the difference between the dark current of the photodetector and the output current of the photodetector when irradiated through the transparent wedge image support at a region of zero image density. The dark current can be determined simply by measuring the output current of the photodetector while the light source of the densitometer is switched off. This procedure can be used regardless of the maximum density of the wedge print and can therefore be used in relation to any continuous tone wedge print as well as in relation to screen wedge prints. In the case of a screen wedge print on steep gradation graphic arts (lith) materials and having so to say 0% light transmission at maximum density the output current of the photodetector while the light source of the densitometer is totally intercepted by the maximum density zone of the print can be taken as the dark current and the measurement can therefore be made without switching off the light source.

In certain embodiments of the method according to the invention, the control print is scanned to determine the distance along the wedge print at which its image density measured in terms of the output current of said detector is in a predetermined ratio to its said notional density range; that distance is compared with the distance along the reference print at which its density value expressed in terms of output current from said detector is in that same predetermined ratio to the notional density range of that reference print; and the difference between those distances is registered as a measure of the sensitivity potential of the developer being assessed.

The invention includes a method wherein in addition to or instead of determining the sensitivity potential of the developer as just described. the control print is scanned to determine first and second positions therealong at which its image densities measured in terms of the output current of said detector are respectively in first and second predetermined ratios to the said notional density range of that print; the distance interval between those positions is compared with the distance interval between the two positions along the reference print at which its image densities expressed in terms of output current from said detector are in the same first and second predetermined ratios to the said notional density range of that reference print; and the difference between those distance intervals is registered as a measure of the contrast potential of the developer being assessed. Preferably the said first and second predetermined ratios are 10% and 95%.

The control wedge prints can be provided with some form of marking to permit automatic detection of the positioning of the wedge print in the wedge reading device. Such marking can for example be in the form of a notch which can be detected by mechanical means, or a spot which can be detected by means of a photodetector or some other kind of detection means.

Advantageously the support of the control wedge print bears a distance scale which is located alongside the wedge print for assisting registration of the distance between one end of the print and any particular position along the print.

The density curve data pertaining to the control print and comparison of such data with analogous data pertaining to the reference print can be effected automatically by electronic means which yields output signals indicative of the developing activity of the developer relative to the norm.

The result of the comparison of analogous data effected by a method according to the invention as above defined can be used for determining the addition of replenishing material to the developer and this replenishment can be achieved automatically in dependence on signals representing those results.

The invention includes apparatus suitable for use in performing a method according to the invention as above defined. The electronic processing means of such apparatus can be coupled to means for automatically delivering replenisher material to a body of photographic developer in dependence on the output signal from such processing means.

BRIEF DESCRIPTION OF THE DRAWING

An embodiment of the invention, selected by way of example only, will now be described with reference to the accompanying diagrammatic drawing which is a simple block diagram of a wedge reader.

DETAILED DESCRIPTION OF THE DRAWING

Figure 1:
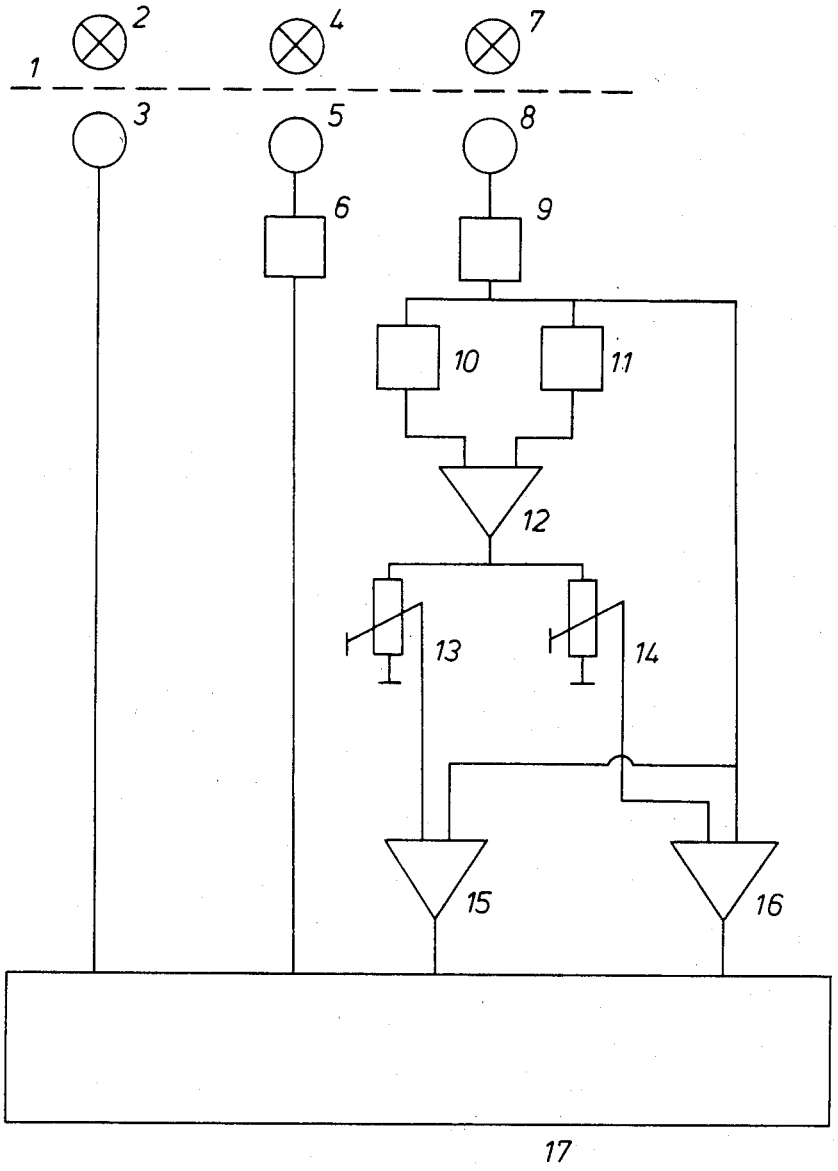

In the illustrated embodiment of the invention, a wedge print 1 is introduced into the light-tight wedge-reading device in a direction perpendicular to the plane of the drawing. A marking on the wedge print passes between light-source 2 and position detector 3. When the wedge print is positioned correctly, a millimeter scale on the photographic wedge print will pass between light-source 4 and photo-detector 5 connected to a counting device 6, whereas the wedge print will pass between light-source 7 and density measuring detector 8.

Immediately after the wedge print is fed into the device, a transparent part of the wedge print becomes located between light source 7 and photodetector 8.

Two extreme values are now measured. The lowermost value is represented by the output current from photodetector 8 while the light source 7 is switched off. Then the light source is switched on so that the detector is exposed through a zero image density zone of the print (in other words through the transparent image support alone).

The output current of photodetector 8 is converted into a voltage by current-to-voltage converter 9.

The two extreme values are compared to give a value representing the notional density range of the wedge print. For this purpose two sample and hold circuits 10 and 11 track the input signal, hold the instantaneous input value upon command by a logic control signal and convert the analog information gained by detector 8 into a constant voltage over a period of time that is long enough to prevent the information, of one circuit from being lost while the other one is still detecting.

Hereafter the difference between the two values measured at the output of sample and hold circuits 10 and 11 is determined by device 12, which can e.g. be an operational amplifier or any other device which is able to generate a signal representing the difference between two signal values.

Two predetermined percentages of the computed measurement range, e.g. 10% and 95%, are derived therefrom by chains 13 and 14. Each of these chains can be a voltage divider for dividing the range represented by the output of chain 12. The output voltage of chain 13, e.g. 10% of the notional density range, is fed into comparator 15. Analogously the output voltage of chain 14, e.g. 95% of said notional range, is fed into comparator 16.

After a delay that enables the sample and hold circuits to sample the analog information obtained as a result of the exposure of detector 8 through a transparent part of the wedge print, a control signal, generated by a microprocessor or a delay circuit, starts to drive the motor of transport rollers which transport the wedge print during the scanning period.

The wedge print is thereby driven lengthwise between light source 7 and detector 8. During this scanning period, the output of detector 8 is fed into both comparators 15 and 16 and each of these comparators 15 and 16 compares that output with the voltage fed into it from the voltage divider or comparable device 13 or 14 as the case may be. When the compared signals are equal the comparator transmits a signal to the input interface of a microprocessor 17.

As a wedge image is being scanned by the photo-electric densitometer, the printed millimeter scale moves past photodetector 5 and the number of scale lines are counted by counter 6 which is connected to the photodetector 5 and feeds corresponding location signals to the microprocessor 17. The microprocessor registers the location signals which coincide in time with the reception of the said equality signals from the comparators 15 and 16 and gives an output signal indicative of the distance between those locations. The value of this output signal is compared with an analogous value regarding the reference wedge. The result of this comparison is a measure of the replenishment required to compensate for aerial oxidation of the developer and can be used for automatically controlling the operation of a replenisher unit for that purpose.

Instead of or in addition to comparing control and reference screen ranges as in the above embodiment, the apparatus can be designed to compare the location of a sensitivity point (e.g. the 10% or 95% dot value location) on a control wedge print with the corresponding recorded datum pertaining to the reference wedge print and to yield a signal which is indicative of the difference between such locations and serves as a measure of the replenishment required to compenate for developer exhaustion with use.

I claim:

1. A method of assessing the developing activity of a photographic developer relative to a norm, which method comprises the steps of using the developer to develop a latent photographic image of a sensitometric wedge, determining density curve data pertaining to the resulting wedge print (hereinafter and in subsequent claims called "control print") by means of a photoelectric transmission densitometer, and comparing such data with analogous data pertaining to at least one reference wedge print resulting from the development of an identical latent sensitometric wedge image in a developer of given activity taken as norm, characterised in that the densitometer is used to determine in respect of the control print: (i) a notional density range in terms of the difference between the dark current of the photodetector of the densitometer and the output current of such detector when it is irradiated by light through the transparent support of such control print at an area of zero image density, and (ii) to determine at least one position along the control print where its image density, as measured in terms of the output current of said detector, is in a predetermined ratio to said notional density range; the data thus established pertaining to the control print is compared with analogous data pertaining to the reference print, established by means of the same densitometer, in order to determine the relationship between the positions along the control and reference prints at which their notional densities are in the same ratio to their respective notional density ranges, and the said relationship is used as a measure of the developing activity of the developer being assessed.

2. A method according to claim 1, wherein the developer being assessed is a high-contrast lith developer for use in developing halftone graphic art images and the said control and reference wedge prints are halftone prints.

3. A method according to claim 1, wherein the control print is scanned to determine the distance along the wedge print at which its image density measured in terms of the output current of said detector is in a predetermined ratio to its said notional density range; that distance is compared with the distance along the reference print at which its density value expressed in terms of output current from said detector is in that same predetermined ratio to the notional density range of that reference print; and the difference between those distances is registered as a measure of the sensitivity potential of the developer being assessed.

4. A method according to claim 1, wherein the control print is scanned to determine first and second positions therealong at which its image densities measured in terms of the output current of said detector are respectively in first and second predetermined ratios to the said notional density range of that print; the distance interval between those positions is compared with the distance interval between the two positions on the reference print at which its image densities expressed in terms of output current from said detector are in the same first and second predetermined ratios to the said notional density range of that reference print; and the difference between those distance intervals is registered as a measure of the contrast potential of the developer being assessed.

5. A method according to claim 4, wherein said first and second predetermined ratios are 10% and 95%.

6. A method according to claim 1, wherein for determining the notional density range of each of the control and reference wedge prints, the current from the said detector is measured when it is irradiated through a said zero image density area of the transparent print support and when the light source is switched on, and the output current of the detector at a time when the light source is switched off is taken as the dark current of said detector.

7. A method according to claim 1, wherein the support of the control wedge print bears a distance scale which is located alongside the wedge print for assisting recording of the distance between one end of the print and any particular position along the print.

8. A method according to claim 1, wherein said density curve data pertaining to the control print and comparison of such data with analogous data pertaining to the reference print are effected automatically by electronic means which yields output signals indicative of the developing activity of the developer relative to said norm.

9. A method according to claim 1, wherein the result of said comparison of analogous data is used for determining the addition of replenishing material to the developer.

* * * * *